US006853831B2

(12) United States Patent
Hirst et al.

(10) Patent No.: US 6,853,831 B2
(45) Date of Patent: Feb. 8, 2005

(54) FUSING SYSTEM INCLUDING AN EXTERNAL HEATER

(75) Inventors: B. Mark Hirst, Boise, ID (US); Kenneth E. Heath, Boise, ID (US); Mark Wibbels, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 257 days.

(21) Appl. No.: 09/819,925

(22) Filed: Mar. 28, 2001

(65) Prior Publication Data

US 2002/0172536 A1 Nov. 21, 2002

(51) Int. Cl.[7] ..... G03G 15/20
(52) U.S. Cl. ..... 399/328; 399/330; 399/331
(58) Field of Search ..... 399/328, 330, 399/331, 319, 324, 332, 333, 334; 219/216; 347/156; 432/59, 60

(56) References Cited

U.S. PATENT DOCUMENTS

| | | | | |
|---|---|---|---|---|
| 4,905,050 | A | 2/1990 | Derimiggio et al. | |
| 5,019,693 | A | 5/1991 | Tamary | |
| 5,450,183 | A | 9/1995 | O'Leary | |
| 5,789,723 | A | 8/1998 | Hirst | 219/501 |
| 5,839,043 | A | 11/1998 | Okabayashi et al. | 399/329 |
| 5,984,848 | A | 11/1999 | Hyllberg et al. | 492/46 |
| 6,018,151 | A | 1/2000 | Hirst | 219/497 |
| 6,122,478 | A | 9/2000 | Hirst | 399/330 |
| 6,181,891 | B1 | 1/2001 | Higashi et al. | 399/70 |
| 2003/0063916 | A1 * | 4/2003 | Katayanagi et al. | 399/44 |
| 2004/0086306 | A1 * | 5/2004 | Edahiro et al. | 399/328 |

* cited by examiner

*Primary Examiner*—Hoan Tran

(57) ABSTRACT

The present disclosure relates to a fusing system for fusing toner to a recording medium. The system includes a fuser roller, a pressure roller in contact with the fuser roller, and an external heating roller. In addition, the disclosure relates to a method for heating a fuser roller of a fusing system. The method includes the steps of providing an external heating roller, contacting an outer surface of the fuser roller with the external heating roller, heating the external heating roller, and rotating the external heating roller and the fuser roller such that heat is transferred from the external heating roller to the fuser roller.

11 Claims, 8 Drawing Sheets

FUSING SYSTEM INCLUDING AN EXTERNAL HEATER

FIELD OF THE INVENTION

The present disclosure relates to a fusing system including an external heater. More particularly, the disclosure relates to a fusing system including an external heating roller.

BACKGROUND OF THE INVENTION

Electrophotographic printing and copying devices typically are provided with fusing systems that serve to thermally fuse a toner image onto a recording medium, such as a sheet of paper. Such fusing systems normally comprise a heated fuser roller and a heated pressure roller that presses against the fuser roller to form a nip in which the fusing occurs. FIG. 1 illustrates a simplified end view of a typical prior art fusing system 100. As indicated in FIG. 1, the fusing system 100 generally comprises a fuser roller 102, a pressure roller 104, internal heating elements 106, and a temperature sensor 108. The fuser and pressure rollers 102 and 104 comprise hollow tubes 110 and 112 that are coated with outer layers 114 and 116 of elastomeric material.

The internal heating elements 106 typically comprise halogen lamps that uniformly irradiate the inner surfaces of the rollers 102 and 104. Through this irradiation, the inner surfaces are heated and this heat diffuses to the outer surfaces of the fuser and pressure rollers 102 and 104 until they reach a temperature sufficient to melt the toner (e.g., approximately between 160° C. to 190° C.). The fuser roller and the pressure rollers 102 and 104 rotate in opposite directions and are urged together so as to form a nip 118 that compresses the outer layers 114 and 116 of the rollers together. The compression of these layers increases the width of the nip 118, which increases the time that the recording medium resides in the nip. The longer the dwell time in the nip 118, the larger the total energy that the toner and recording medium can absorb to melt the toner. Within the nip 118, the toner is melted and fused to the medium by the pressure exerted on it by the two rollers 102 and 104. After the toner has been fused, the recording medium is typically forwarded to a discharge roller (not shown) that conveys the medium to a discharge tray.

The outer layers 114 and 116 are normally constructed of rubber materials (e.g., silicon rubber) that have high thermal resistance. Where, as indicated in FIG. 1, the rollers 102 and 104 are heated internally, this high thermal resistance creates a heat transport delay that results in a relatively long warm-up time (i.e., the duration of time required for the fusing system to reach operating temperature). The reason for this delay can be explained by the thermal model 200 shown in FIG. 2. The thermal model 200 represents the thermal characteristics of the fuser roller 102 shown in FIG. 1 as a recording medium (e.g., sheet of paper) passes through the nip 118. As indicated in FIG. 2, the model 200 comprises a circuit that includes a thermal energy source 202 representative of the internal heating element 106. The energy source 202 delivers a constant amount of energy to a thermal capacitor C1 that is representative of the hollow tube 110 of the fuser roller 102. The energy provided by the energy source 202 must overcome the thermal resistance provided by the resistor R1, which represents the outer layer 114. Due to the large thermal resistance of the materials used to construct the outer layer 114, the resistance provided by R1 is very large. In addition, the energy from the source 202 must overcome the thermal resistance of the resistor R2, which represents heat loss due to convection. The energy also reaches a second thermal capacitor C2 representative of the thermal capacitance of the outer layer 110. Finally, the energy encounters the thermal resistance of resistor RL, which represents the thermal load of the recording medium that passes through the nip 118. Heat generated by the passage of the energy through the resistor RL is represented by "+" and "−" in FIG. 2.

As will be appreciated by persons having ordinary skill in the art, the large resistance of the resistor R1 poses an impediment to the transfer of energy from the interior of the fuser roller 102 to the fuser roller outer surface of the outer layer. This impediment creates the heat transport delay which is the primary cause of delay in the warming of the fusing system 100. In addition, the high thermal resistance also results in gloss variation along the length of the recording media. As is known in the art, gloss variation relates to the phenomenon in which the gloss of the fused toner changes over the length of the recording medium. This variation is due to the fact that the fuser roller 102 typically has a circumference which is smaller than the length of the recording medium. Therefore, the fuser roller 102 will normally pass through several revolutions as the recording medium passes through the nip 118. Due to the transfer of heat to the medium through each revolution, the temperature of the fuser roller 102 can drop significantly from the leading edge of the medium to its trailing edge. This can result in the printed recording medium having a first section adjacent its leading edge in which the printed media is highly glossy, a second section at its middle where the printed media has a less glossy finish, and a third section adjacent its trailing edge in which the printed media has a non-glossy (i.e., matte) finish.

Gloss variation is undesirable for several reasons. First, printed materials having gloss variation are unaesthetic in that the printed media have an inconsistent appearance. This is particularly true in the case of color printing or photocopying in that the glossy portions of the printed media will appear more vibrant than less glossy portions. Second, a glossy finish normally indicates better fusing to the recording medium. With good fusing, there will be better adhesion between the toner and the recording medium and therefore less chance of the toner flaking off of the recording medium.

A further problem with current fusing systems that incorporate internal heating is temperature overshoot. Temperature overshoot occurs when the temperature of the rollers 102 and 104 exceeds the target temperature set for the rollers. Normally, such overshoot occurs due to the time delay between the application of energy to the rollers 102 and 104 and the temperature response caused by the heat transport delay. Temperature overshoot tends to overheat the toner such that it will not properly adhere to the recording medium. In addition, temperature overshoot causes fusing system degradation in that the temperatures reached by the rollers can cause delamination of the outer layers 114 and 116, thereby significantly reducing the useful life of the fusing system 102.

From the foregoing, it can be appreciated that it would be desirable to have a fusing system that avoids one or more of the disadvantages described above typically associated with internal heating.

SUMMARY OF THE INVENTION

The present disclosure relates to a fusing system for fusing toner to a recording medium. The system comprises a fuser roller, a pressure roller in contact with the fuser roller, and an external heating roller.

In addition, the disclosure relates to a method for heating a fuser roller of a fusing system. The method comprises the steps of providing an external heating roller, contacting an outer surface of the fuser roller with the external heating roller, heating the external heating roller, and rotating the external heating roller and the fuser roller such that heat is transferred from the external heating roller to the fuser roller.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 3:
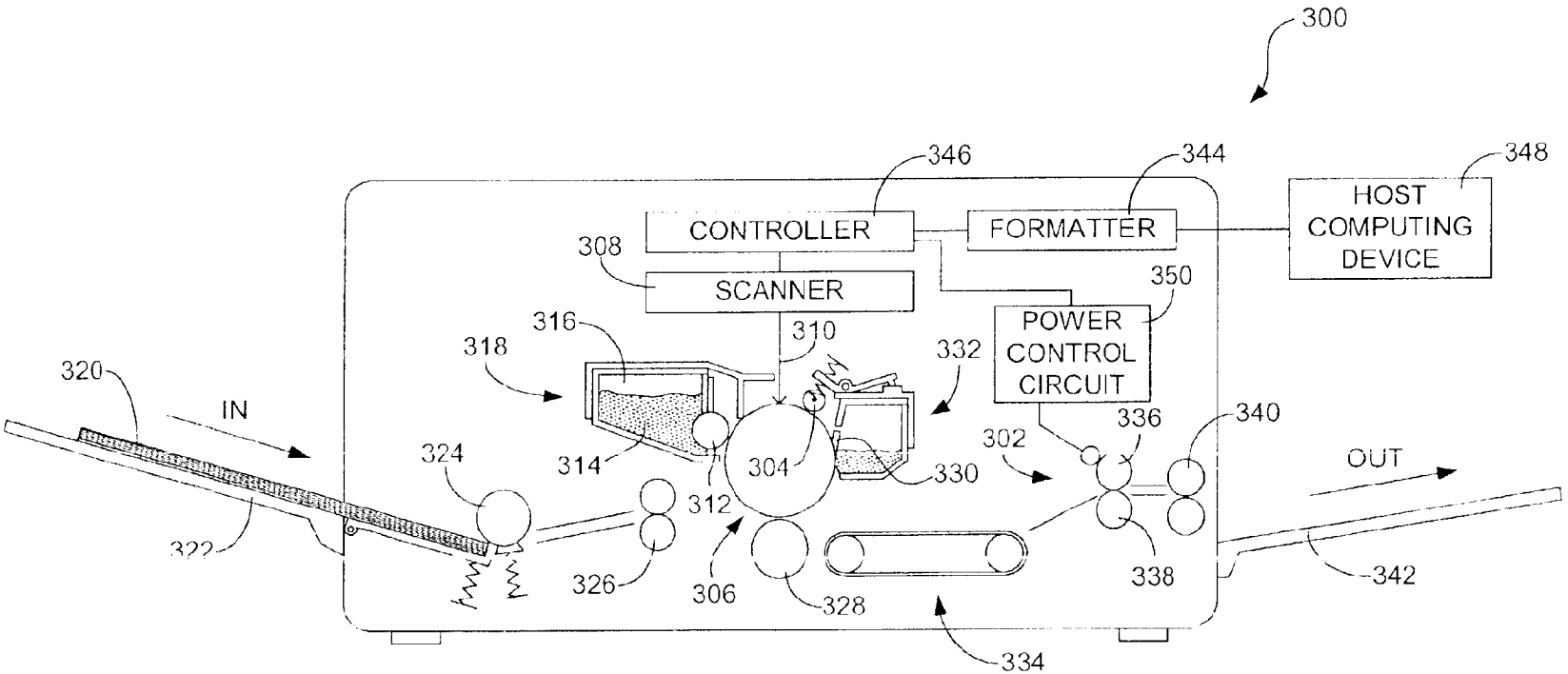
FIG. 3 is a schematic side view of an electrophotographic imaging device incorporating a first fusing system.

Referring now in more detail to the drawings, in which like numerals indicate corresponding parts throughout the several views, FIG. 3 illustrates a schematic side view of an electrophotographic imaging device 300 that incorporates a first fusing system 302. By way of example, the device 300 comprises a laser printer. It is to be understood, however, that the device 300 can, alternatively, comprise any other such imaging device that uses a fusing system including, for instance, a photocopier or a facsimile machine.

As indicated in FIG. 3, the device 300 includes a charge roller 304 that is used to charge the surface of a photoconductor drum 306, to a predetermined voltage. A laser diode (not shown) is provided within a laser scanner 308 that emits a laser beam 310 which is pulsed on and off as it is swept across the surface of the photoconductor drum 306 to selectively discharge the surface of the photoconductor drum. In the orientation shown in FIG. 3, the photoconductor drum 306 rotates in the counterclockwise direction. A developing roller 312 is used to develop a latent electrostatic image residing on the surface of photoconductor drum 306 after the surface voltage of the photoconductor drum has been selectively discharged. Toner 314 is stored in a toner reservoir 316 of an electrophotographic print cartridge 318. The developing roller 312 includes an internal magnet (not shown) that magnetically attracts the toner 314 from the print cartridge 318 to the surface of the developing roller. As the developing roller 312 rotates (clockwise in FIG. 3), the toner 314 is attracted to the surface of the developing roller 312 and is then transferred across the gap between the surface of the photoconductor drum 306 and the surface of the developing roller to develop the latent electrostatic image.

Recording media 320, for instance sheets of paper, are loaded from an input tray 322 by a pickup roller 324 into a conveyance path of the device 300. Each recording medium 320 is individually drawn through the device 300 along the conveyance path by drive rollers 326 such that the leading edge of each recording medium is synchronized with the rotation of the region on the surface of the photoconductor drum 306 that comprises the latent electrostatic image. As the photoconductor drum 306 rotates, the toner adhered to the discharged areas of the drum contacts the recording medium 320, which has been charged by a transfer roller 328, such that the medium attracts the toner particles away from the surface of the photoconductor drum and onto the surface of the medium. Typically, the transfer of toner particles from the surface of the photoconductor drum 306 to the surface of the recording medium 320 is not completely efficient. Therefore, some toner particles remain on the surface of the photoconductor drum. As the photoconductor drum 306 continues to rotate, the toner particles that remain adhered to the drum's surface are removed by a cleaning blade 330 and deposited in a toner waste hopper 332.

As the recording medium 320 moves along the conveyance path past the photoconductor drum 306, a conveyer 334 delivers the recording medium to the fuser system 302. The recording medium 320 passes between a fuser roller 336 and a pressure roller 338 of the fusing system 302 that are described in greater detail below. As the pressure roller 338 rotates, the fuser roller 336 is rotated and the recording medium 320 is pulled between the rollers. The heat applied to the recording medium 320 by the fusing system 302 fuses the toner to the surface of the recording medium. Finally, output rollers 340 draw the recording medium 320 out of the fusing system 302 and delivers it to an output tray 342.

As identified in FIG. 3, the device 300 can further include a formatter 344 and a controller 346. The formatter 344 receives print data, such as a display list, vector graphics, or raster print data, from a print driver operating in conjunction with an application program of a separate host computing device 348. The formatter 344 converts the print data into a stream of binary print data and sends it to the controller 346. In addition, the formatter 344 and the controller 346 exchange data necessary for controlling the electrophotographic imaging process. In particular, the controller 346 supplies the stream of binary print data to the laser scanner 308. The binary print data stream sent to the laser diode within the laser scanner 308 pulses the laser diode to create the latent electrostatic image on the photoconductor drum 306.

In addition to providing the binary print data stream to the laser scanner 308, the controller 346 controls a high voltage power supply (not shown) that supplies voltages and currents to the components used in the device 300 including the charge roller 304, the developing roller 312, and the transfer roller 328. The controller 346 further controls a drive motor (not shown) that drives the printer gear train (not shown) as well as the various clutches and feed rollers (not shown) necessary to move recording media 320 through the conveyance path of the device 300.

A power control circuit 350 controls the application of power to the fusing system 302. In a preferred arrangement, the power control circuit 350 is configured such that the power to the fusing system 302 is linearly controlled and the power levels can be smoothly ramped up and down as needed. Such control provides for better control over the amount of heat generated by the fusing system 302. While the device 300 is waiting to begin processing a print or copying job, the temperature of the fuser roller 336 is kept at a standby temperature corresponding to a standby mode.

In the standby mode, power is supplied at a reduced level to the fuser roller 336 by the power control circuit 350 to reduce power consumption, lower the temperature, and reduce the degradation resulting from continued exposure to the components of the fusing system 302 to the fusing temperatures. The standby temperature of the fuser roller 336 is selected to balance a reduction in component degradation against the time required to heat the fuser roller from the standby temperature to the fusing temperature. From the standby temperature, the fuser roller 336 can be quickly heated to the temperature necessary to fuse toner to the recording media 320. When processing of a fusing job begins, the controller 346, sufficiently ahead of the arrival of a recording medium 320 at the fusing system 302, increases the power supplied by the power control circuit 350 to the fusing system to bring its temperature up to the fusing temperature. After completion of the fusing job, the controller 346 sets the power control circuit 350 to reduce the power supplied to the fusing system 302 to a level corresponding to the standby mode. The cycling of the power supplied to fusing system 302 is ongoing during the operation of device as fusing jobs are received and processed and while the device is idle.

Figure 4:
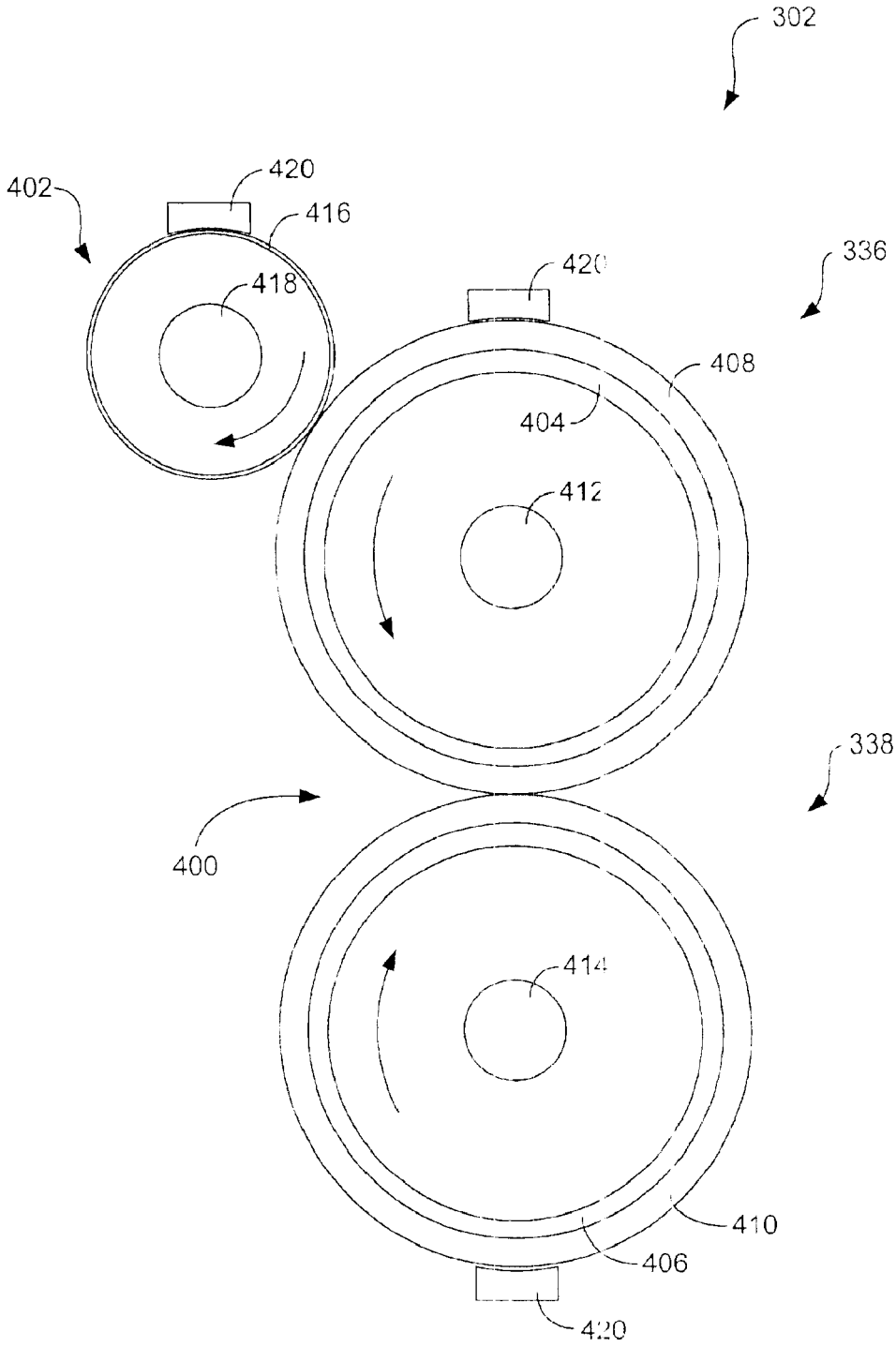
FIG. 4 is a simplified end view of the fusing system shown in FIG. 3.

FIG. 4 illustrates a simplified end view of the fusing system 302 shown in FIG. 3. As indicated in FIG. 4, the fusing system 302 generally comprises the fuser roller 336 and the pressure roller 338 that together form a nip 400 therebetween. In addition, the fusing system 302 includes an external heater 402 that, as indicated in FIG. 4, preferably comprises an external heating roller. For the purposes of convenience, the external heater 402 will be referred to herein as an external heating roller. It will be understood, however, that alternative external heaters could be used, such as an external induction heating element. The fuser roller 336 and pressure roller 338 typically are formed as hollow tubes 404 and 406. By way of example, each of these tubes 404 and 406 is composed of a metal such as aluminum or steel and has a diameter of approximately 45 millimeters (mm). By further way of example, each tube 404 and 406 can have a thickness of approximately 2.5 mm. Each roller 336 and 338 is provided with an outer layer 408 and 410 of an elastomeric material such as silicon rubber or a flexible thermoplastic. By way of example, the outer layers 408 and 410 are approximately 4 mm thick. To prevent toner from adhering to the outer layers 408 and 410, a layer of Teflon (not visible in FIG. 4) can be applied to the outer layers. This layer of Teflon can, for instance, have a thickness of approximately 1.5 to 2 mils. Although particular arrangements for the fuser and pressure rollers 336 and 338 have been shown and described, it is to be understood that these arrangements are merely exemplary and that alternative arrangements are feasible and may even be preferable.

Inside each of the fuser and pressure rollers 336 and 338 is an internal heating element 412 and 414. By way of example, the internal heating elements 412 and 414 comprise halogen lamps or nichrome heating elements. Normally, the heating elements 412 and 414 are at least as long as the rollers 336 and 338 such that the elements can be fixedly mounted in place. When formed as halogen lamps, the internal heating elements 412 and 414 can have power ratings of, for example, approximately 600 watts (W) and 100 W, respectively. It is to be noted that, although an internal heating element 414 is shown and described, the pressure roller 338 could, alternatively, be configured without its own heat source. Preferably, however, such a heat source is provided to avoid the accumulation of toner on the pressure roller 338 during use.

As identified above, the thermal resistance of roller outer layers 408 and 410 typically creates heat transport delays in internally heated systems that result in temperature lag and overshoot problems. To avoid these problems, heat is also applied externally, directly to the outer layer 408 of the fuser roller 336, with the external heating roller 402. As indicated in FIG. 4, the external heating roller 402 preferably comprises a hollow tube 416. Like the hollow tubes 404 and 406, the hollow tube 416 typically is composed of a metal such as aluminum or steel. However, to avoid a substantial increase in the height dimension of the fusing system 302, the hollow tube 416 preferably has relatively small diameter, e.g. approximately 1 inch (in). In addition, the external heating roller 402 is preferably arranged at approximately the ten o'clock position relative to the fuser roller 336. Although such positioning is shown and described, it will be appreciated that alternative placement is feasible. The tube 416 can be thinner than the tubes 404 and 406 in that the external heating roller 402 need not be compressed to form a nip. By way of example, this thickness can be approximately 0.03 in. Formed on the exterior of the hollow tube 416 is a layer of Teflon (not visible in FIG. 4) that, for instance, has a thickness of approximately 1.5 to 2 mils. As with the other Teflon layers, this Teflon layer reduces the likelihood of toner adhering to the external heating roller 402 during use.

Like the fuser and pressure rollers 336 and 338, the external heating roller 402 normally comprises an internal heating element 418 that, by way of example, comprises a tungsten filament halogen lamp or nichrome heating element. When formed as halogen lamp, the internal heating element 418 can have a power rating of, for example, approximately 600 W. Also provided in the fusing system 302 is one or more temperature sensors 420. The temperature sensors 420 can comprise sensors that are placed in close proximity to or in contact with the rollers (e.g., thermistors). By way of example, the sensors 420 for the fuser roller 336 and the external heating roller 402 can be positioned at the twelve o'clock positions and the sensor 420 for the pressure roller 336 can be positioned at the six o'clock position. Although this placement is shown and described, it will be appreciated that alternative placement is also feasible. Furthermore, it is to be appreciated that the sensors 420 can alternatively comprise non-contact thermopiles (not shown), if desired. Although non-contact thermopiles are preferable from the standpoint of reliability, they are more expensive and therefore increase the cost of the device 100.

In operation, power is supplied to the heating elements 412, 414, and 418 by the control circuit 350 (FIG. 3) so as to heat each of the hollow tubes 404, 406, and 416 with radiated heat. As identified above, heating of the pressure roller 338 is optional in that enough heat may be provided by the internal heating elements 412 and 418 alone. Relatively moderate heating of the pressure roller 338 is deemed preferable however to avoid the accumulation of toner on the outer layer 410 of the pressure roller. By way of example, power is supplied to the heating elements 412, 414, and 418 such that the fuser and pressure rollers 336 and 338 are maintained at set point temperatures of approximately 185° C. to 195° C., and the external heating roller 402 is maintained at a set point temperature of approximately 220° C. to 240° C.

Due to the provision of the external heating roller 402, the outer surface of the fuser roller outer layer 408 can be heated more easily. In particular, heat energy can be delivered directly to the outer surface of the fuser roller 336 without having to travel through the outer layer 408. This arrangement is illustrated by the thermal model 500 shown in FIG. 5. This thermal model 500 represents the fuser roller 336 in combination with the external heating roller 402 shown in FIG. 4 as a recording medium (e.g., sheet of paper) passes through the nip 400. As indicated in FIG. 5, the model 500, like model 200, comprises a circuit that includes a thermal energy source 502 representing the internal heating element 412, a thermal capacitor Cl representing the thermal capacitance of the hollow tube 404, a resistor R1 representing the outer layer 408, a resistor R2 representing heat loss due to convection, a second thermal capacitor C2 representing the thermal capacitance of the outer layer, and a resistor RL that represents the thermal load of the recording medium that passes through the nip.

Figure 5:
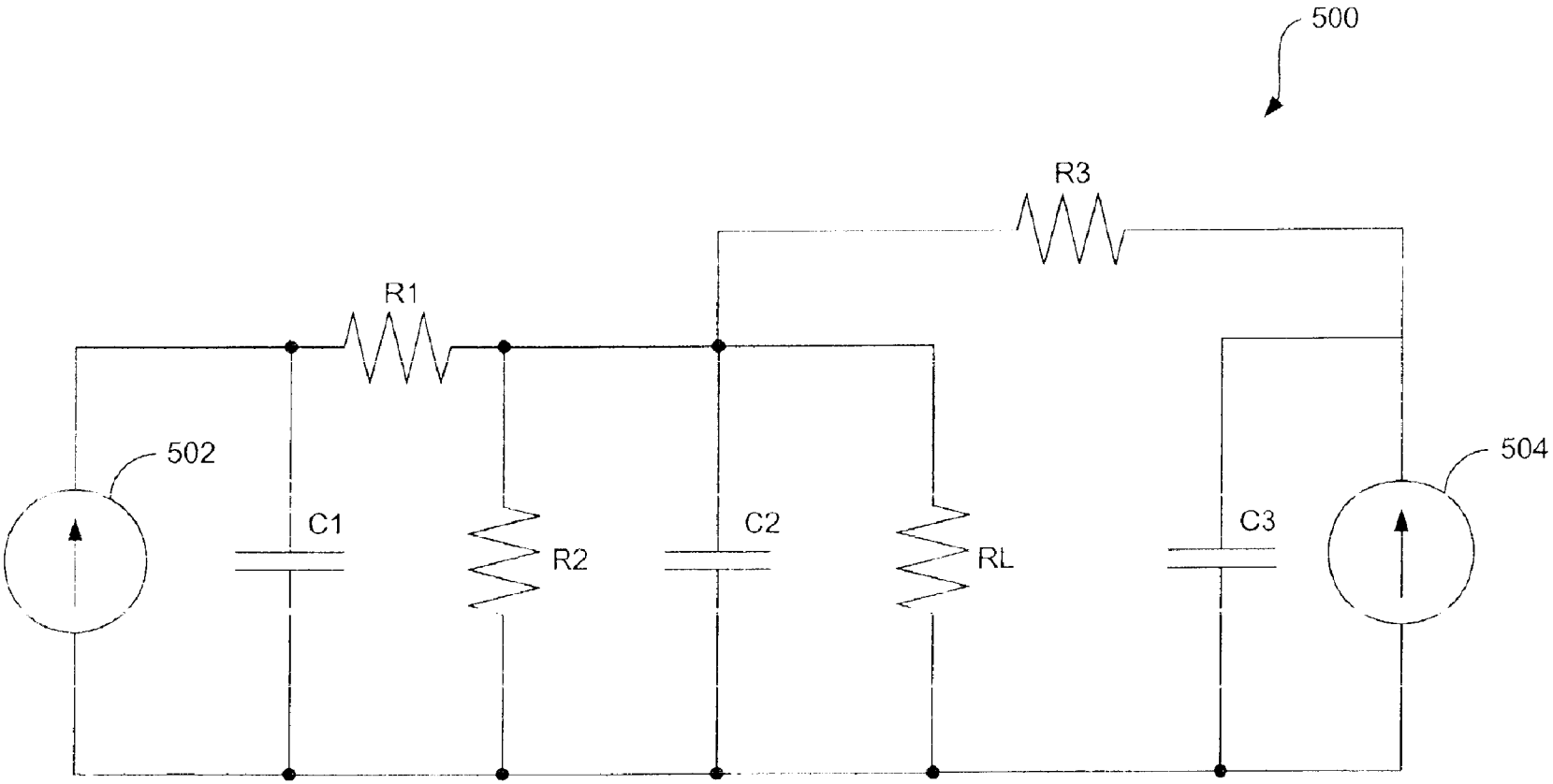
FIG. 5 is a thermal model of the fusing system shown in FIG. 4.

In the model 500 shown in FIG. 5, the circuit further includes a second thermal energy source 504 that represents the internal heating element 418 of the external heating roller 402, a third thermal capacitor C3 representing the thermal capacitance of the hollow tube 416, and a third resistor R3 representing the thermal resistance between the external heating roller and the fuser roller 336. Unlike R1, R3 is very small, for instance several orders of magnitude smaller than R1. Therefore, heat energy provided by the second energy source 504 encounters little resistance. Accordingly, the outer surface of the fuser roller 336 can be heated much more easily.

With the arrangement depicted in FIG. 4 and represented in FIG. 5, the outer surface of the fuser roller 336 can be heated more quickly than with internal heating alone. This reduces warm-up time and improves the transient response of the fusing system 302. Therefore, the target operating temperature of the system can be reached quickly when a printing or copying job is initiated, and this operating temperature can be regained more quickly after each recording medium passes through the nip 400. In order to more precisely control heating and avoid temperature overshoot, the temperature of each roller is preferably monitored individually with the separate temperature sensors 420 such that the power supplied to each of the heating elements 414, 414, and 418 can be individually controlled. By way of example, this control can be provided with point controllers of the power control circuit 350. With such a control arrangement, the temperature of the external heating roller 402 is controlled such that its temperature will not rise to a point at which damage could occur to the outer layers 404 and 406 of the fuser and pressure rollers 336 and 338.

Figure 6:
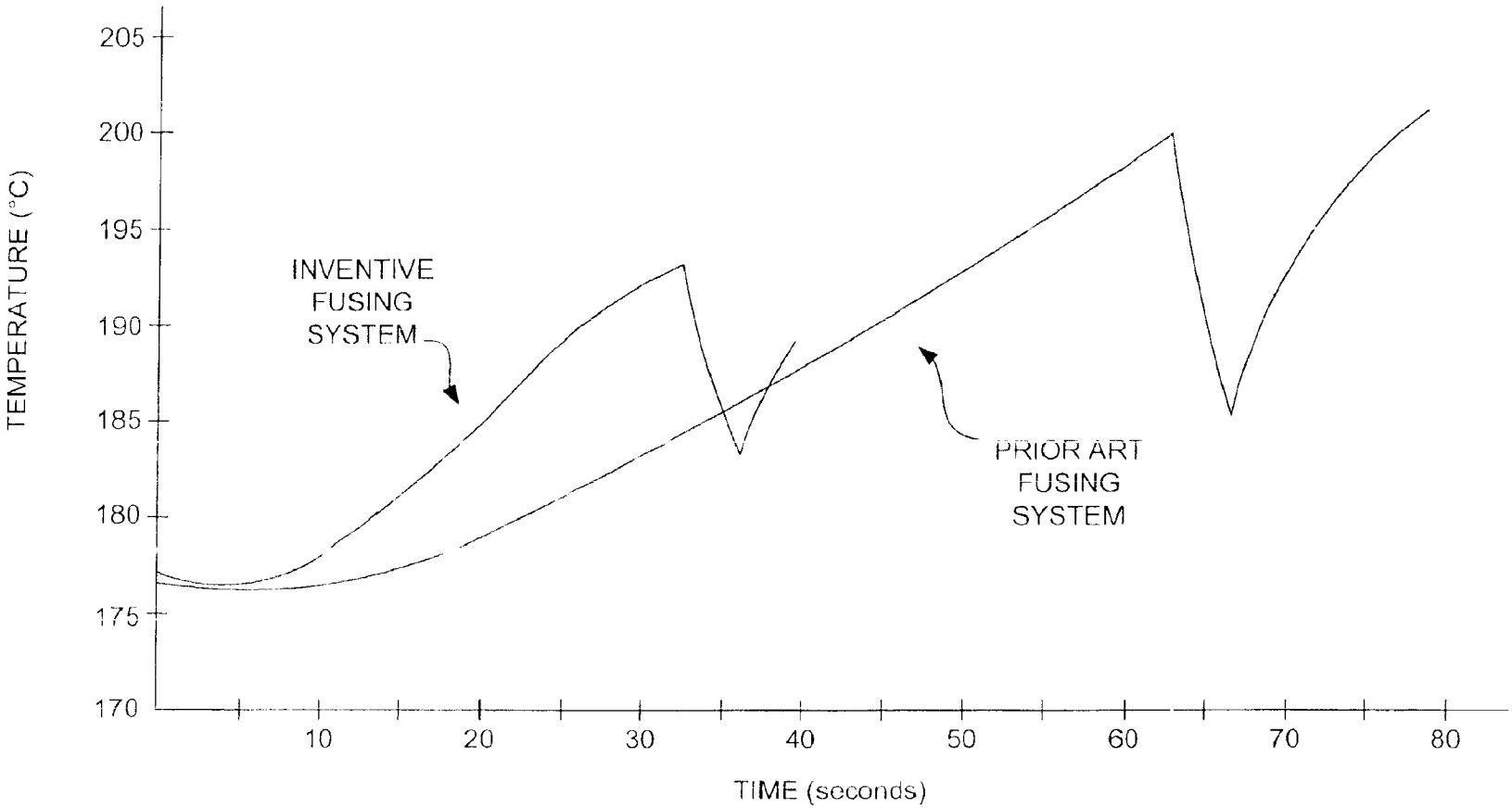
FIG. 6 is a graph comparing the warm-up times of a prior art fusing system and a fusing system including an external heating roller.

FIG. 6 provides a graph that compares the ready-to-fuser times of a prior art fusing system and a fusing system including an external heating roller. More particularly, shown are the temperature responses of the fuser rollers of these systems. The data were obtained through testing of an actual, known fusing system and a prototype inventive fusing system. As is known in the art, ready-to-fuser time relates to the duration of time from the ready (i.e., standby) state to the time at which recording media first enters the fusing system. In such an instance, the fuser roller is heated from a standby temperature (e.g., 170° C. to 175° C.) to a fusing temperature (e.g., 185° C. to 195° C.).

Figure 1:
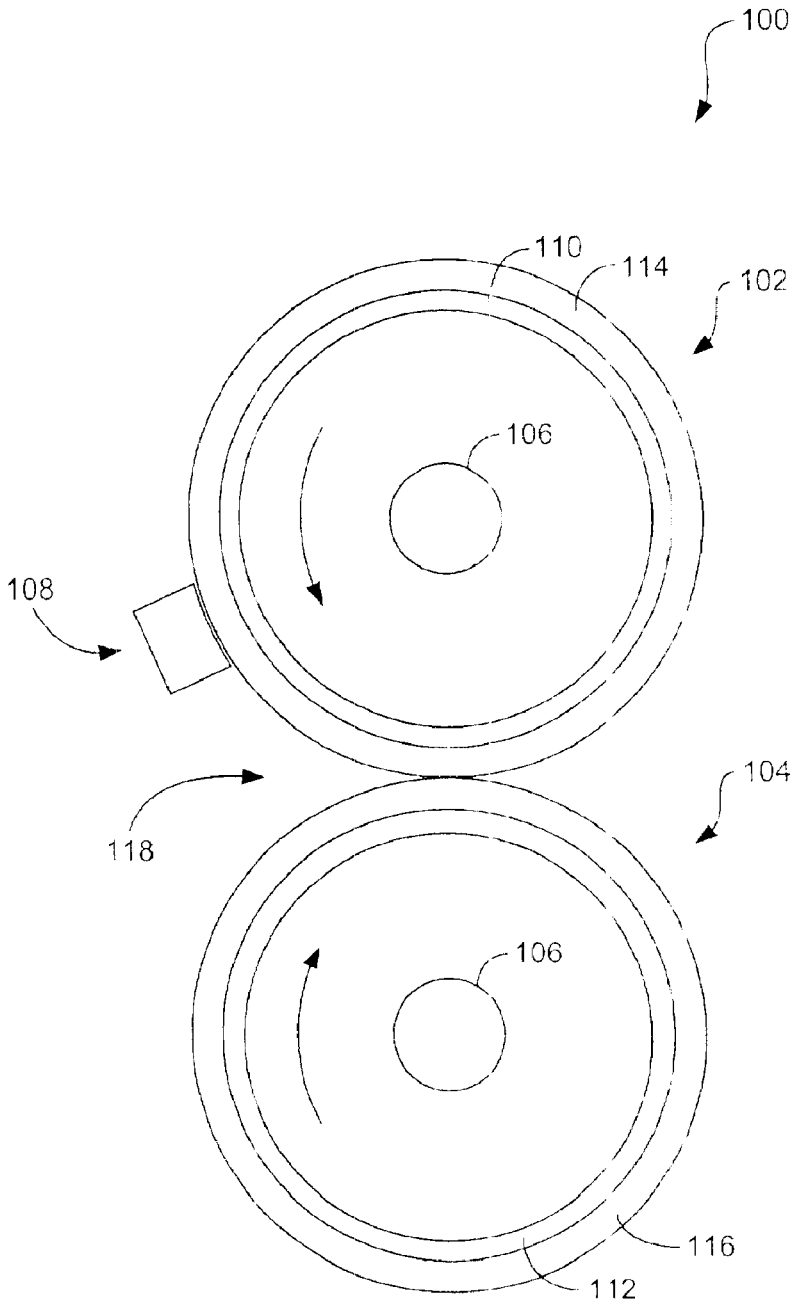
FIG. 1 (PRIOR ART)
FIG. 1 is a simplified end view of a prior art fusing system.
Figure 2:
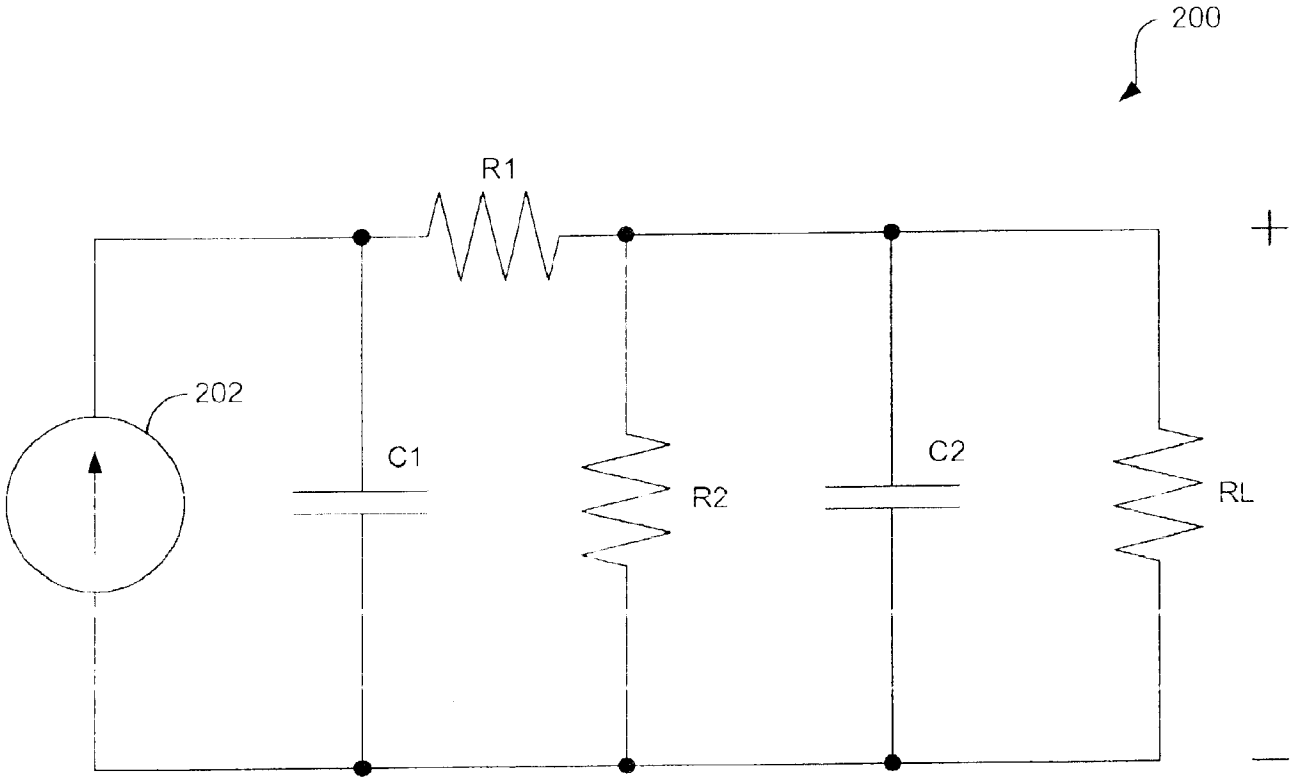
FIG. 2 (PRIOR ART)
FIG. 2 is a thermal model of the fusing system shown in FIG. 1.

The prior art fusing system had the general construction of the fusing system 100 shown in FIG. 1. Therefore, the fusing system included a fuser roller, a pressure roller, an internal heating element provided in each roller, and a temperature sensor provided on the fuser roller. The heating elements both comprised 595 W tungsten filament halogen lamps. The prototype fusing system had the general construction shown in FIG. 4 and therefore comprised a fuser roller, a pressure roller, and an external heating roller. Each roller was formed as a hollow tube that included a tungsten filament halogen lamp as a heat source. The lamps in the fuser roller, pressure roller, and the external heating roller had power ratings of 595 W, 100 W, and 500 W, respectively. Notably, however, the power supplied to both the prior art fusing system and the prototype fusing system was limited to 900 W during testing so that the total power provided to each system was equal.

As identified in FIG. 6, the standby temperature for both fusing systems was set at approximately 177° C. The warm-up sequence was initiated at t=0 by issuing a print command to the print engine of a printer in which the fusing systems were independently installed. The target temperature of the fusing systems were increased to approximately 190° C. The printer was configured to initiate the printing process as soon as the temperatures of the fuser and pressure rollers surpassed 190° C. Approximately 7 seconds after printing process initiation, the recording media entered the nips of the fusing systems, causing associated temperature drops for the fuser rollers. In that the duration of the time required between initiation of the print process and arrival of the first recording medium at the fusing system is largely dependent upon the time required to heat the fusing system to fusing temperatures, examination of the ready-to-fuser time provides a indication of the effectiveness of the fusing system. As indicated in FIG. 6, of the fusing systems were increased the recording media entered the nip of the inventive fusing system after approximately 33 seconds, while it took approximately 63 seconds for such entry with the prior art fusing system Therefore, the inventive fusing system is significantly improved over that of the prior art fusing system. In addition, the peak temperature reached by the inventive fusing system was approximately 194° C., while the peak temperature reached by the prior art fusing system was approximately 200° C. Therefore, the inventive fusing system had a temperature overshoot of only approximately 4° C., while the prior art fusing system exhibited as overshoot of approximately 10° C. Further information can be gleaned from the plots of FIG. 6. In particular, the temperature sag reflective of the arrival of the first recording media (sheets of paper) at the nip and their passage there through was much less for the inventive fusing system. Specifically, the inventive fusing system had a temperature sag of only approximately 9° C. (between t=33s and t=36s), while the prior art fusing system had a temperature sag of approximately 14° C. (between t=62s and t=66s). Accordingly, the inventive fusing system recovers much more quickly than the prior art fusing system.

Figure 7:
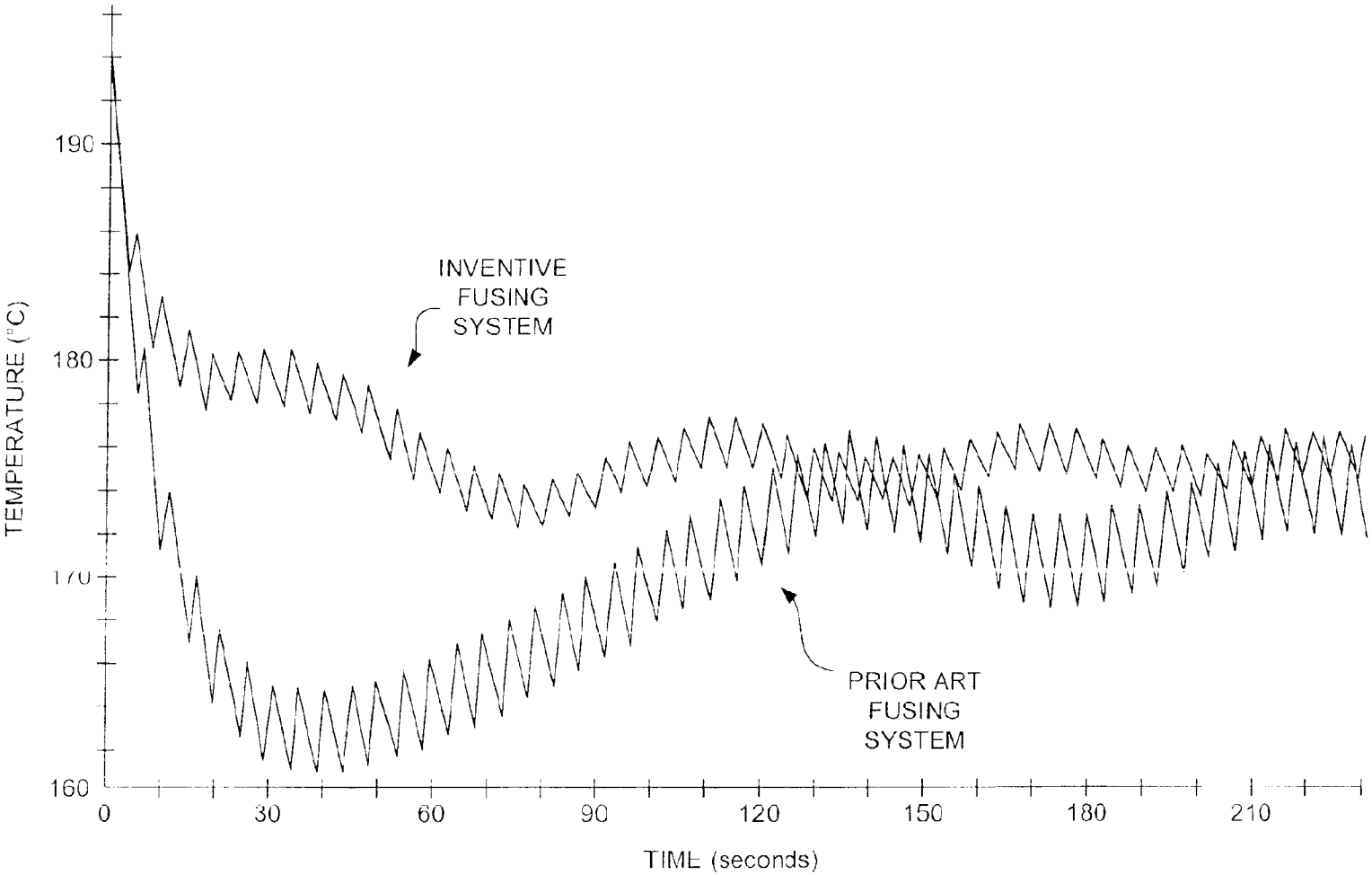
FIG. 7 is a graph that plots fuser roller temperature versus time for a prior art fusing system and a fusing system including an external heating roller.

FIG. 7 provides a graph that plots fuser roller temperature versus time for the aforementioned prior art fusing system and inventive fusing system. Again, the prior art fusing system had the general construction of the fusing system 100 shown in FIG. 1 and the prototype fusing system had the general construction shown in FIG. 4 (and therefore included an external heating roller). Also, the power provided to each system was limited to 900 W. In the testing that resulted in the data shown in FIG. 7, 28 pound tabloid paper was run through the fusing systems. As is known in the art, this paper is a heavy weight paper and therefore represents an example worst case scenario for the fusing systems. As indicated in FIG. 7, paper was continually fed through the fusing systems, resulting in the jagged response shown in the figure which represents the temperature drops that occur when the paper was passed through the systems and the temperature increases that occurred thereafter.

As is evident from the plots in FIG. 7, the inventive fusing system suffered a relatively small initial temperature dip before oscillating about the target temperature (approximately 175° C.) as compared to the large temperature dip experienced by the prior art fusing system. In particular, the inventive fusing system experienced only a 12° C. drop during the first thirty seconds compared to the prior art fusing system's 30° C. drop. In fact, the temperature of the inventive fusing system did not fall below the oscillation range achieved once stabilization was achieved. In contradistinction, the prior art fusing system operated well below the desired temperature range for approximately 20 of the sheets of paper that first passed through its nip. As is known in the art, this condition increases the likelihood of unacceptable fusing of toner to the recording medium. In addition to above-noted information, the graph shown in FIG. 7 reveals that the initial temperature of the fuser roller (approximately 194° C. in FIG. 7) can be lowered in the inventive fusing system since the initial temperature dip for this system was so modest. This, in turn, will likely increase the longevity of the fusing systems in that the outer layers of the rollers need not be exposed to extreme temperatures during use.

Table I provides further data comparing the aforementioned prior art fusing system and the inventive fusing system. The temperature of the external roller of the inventive fusing system was maintained at approximately 240° C. and the fuser roller and pressure roller of the system were maintained at approximately 180° C. To provide a valid comparison of the performance of the inventive fusing system and the prior art system, the total power for each system was again limited to 900W during testing. One of the most widely used characteristics of merit for comparing two similar fusing systems is the initial warm-up time. As is known in the art, initial warm-up time relates to the time required for the temperature of a fuser roller to increase from an ambient temperature of 25° C. to the "ready" set point temperature. As indicated in the first column of Table I, the inclusion of the external heating roller substantially decreased the initial warm-up time of the inventive fusing system as compared to the prior art system. This was accomplished without increasing the power supplied to the fusing system.

TABLE I

| | Time to 180° C. from Cold Start (25° C. (minutes) | Time from Ready to First Page Entering the Fuser (seconds) | Max Temperature Sag Printing 28/20 lbs. Tabloid Page ° C. | Temperature Sag Printing 28/20 lbs. Tabloid Page ° C. |
|---|---|---|---|---|
| Prior Art Sys. | 3:52 | 63 | 32/18 | 5/4 |
| Inventive Sys. | 2:50 | 26 | 16/10 | 2.5/2 |

As shown in the second column of Table 1, the improved performance of the inventive system allows further improvement in the ready-to-fuser time over the initially improved performance shown in FIG. 6. This is accomplished by taking advantage of the improved temperature response of the inventive system and decreasing the target temperature from 185° C. to 190° C. This decreases the ready-to-fuser time from 63 seconds for the prior art system to 26 seconds for the inventive system. The third and fourth columns of Table 1 show two additional benefits of the inventive system. First, the maximum temperature deviation or sag at the start of a continuous print job was reduced. Second, the maximum temperature variation within a page during a continuous print job was reduced. These data were extracted from the plots of FIG. 7. The decrease in initial temperature sag and temperature variation within a page improve both the fusing of the toner to the recording media as well as the gloss variation within each page.

Figure 8:
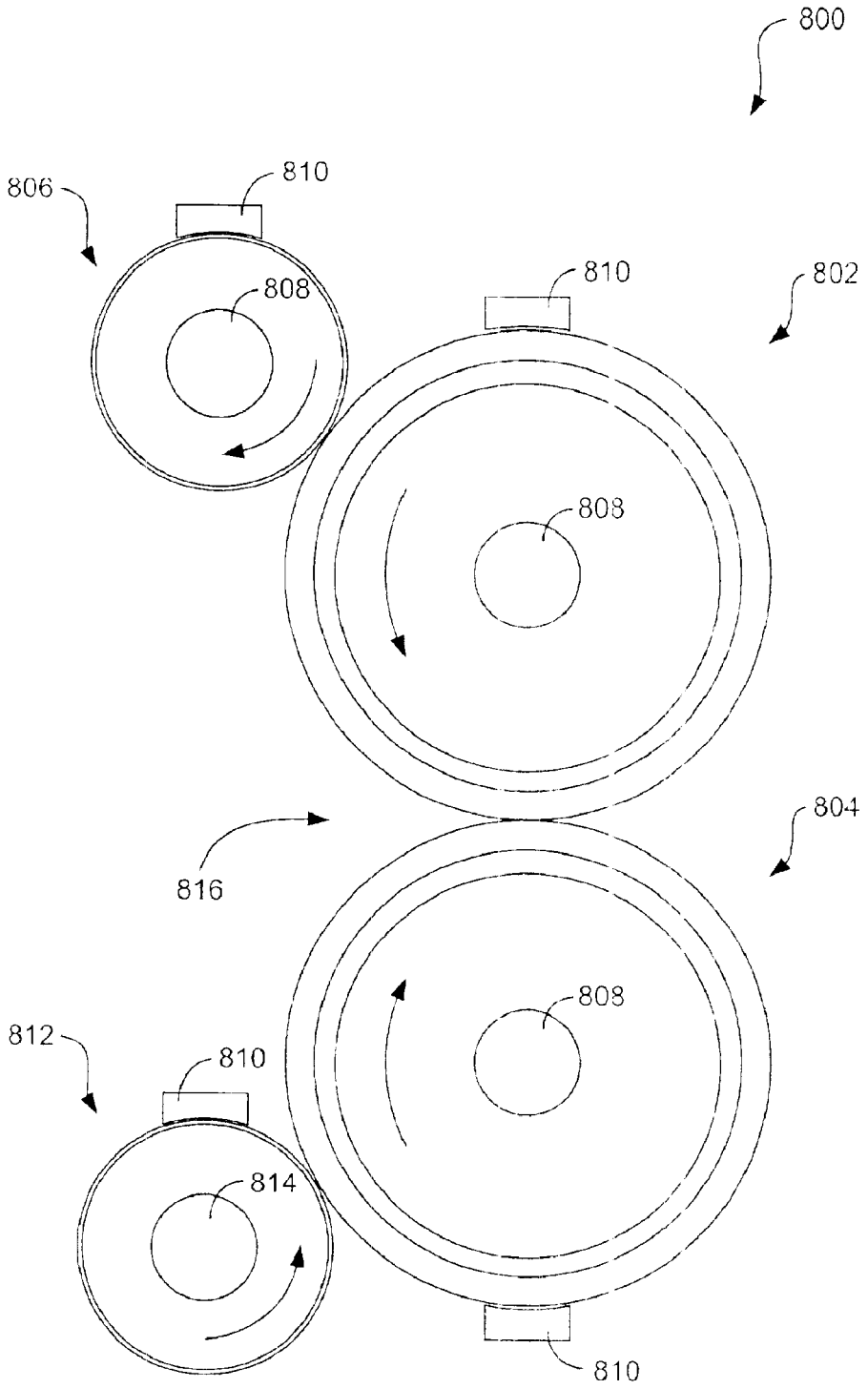
FIG. 8 is a simplified end view of a second fusing system.

FIG. 8 illustrates a second fusing system 800. This fusing system 800 is similar to the fusing system 302 shown in FIG. 4. Accordingly, the fusing system 800 includes a fuser roller 802, a pressure roller 804, an external heating roller 806, internal heating elements 808, and temperature sensors 810, each of similar construction as those mentioned above. In addition, however, the fusing system 800 further includes a second external heating roller 812 that includes a heating element 814 similar to that provided in the external heating roller 806. As indicated in FIG. 8, the second external heating roller 806 preferably contacts the pressure roller 804 at a position that does not substantially increase the height dimension of the fusing system, e.g. at the eight o'clock position relative to the pressure roller.

The fusing system 800 operates in similar manner to the fusing system 302 described above. However, due to the provision of the second external heating roller 812, the thermal resistance of the outer layer of the pressure roller 804 is not as significant of a factor in heating the outer surface of the pressure roller. Accordingly, more heat can be provided to the nip 816 formed between the fuser roller 802 and the pressure roller 804 with less resistance, resulting in even faster heating and further reduced warm-up times.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A fusing system for fusing toner to a recording medium, comprising:

a fuser roller including a hollow tube and an internal heating element;

a pressure roller in contact with the fuser roller;

a first heating roller external to and in contact with the fuser roller; and a second heating roller external to and in contact with the pressure roller.

2. The system of claim 1, wherein the fuser roller comprises a hollow tube and an internal heating element.

3. The system of claim 1, wherein the pressure roller comprises an outer layer composed of an elastomeric material.

4. The system of claim 1, wherein the pressure roller comprises an outer layer composed of an elastomeric material.

5. The system of claim 1, wherein at least one of the heating rollers comprises a hollow tube and an internal heating element.

6. The system of claim 5, wherein at least one of the internal heating elements comprises a tungsten filament halogen lamp.

7. A fusing system for fusing toner to a recording medium, comprising:

a hollow fuser roller having an internal heating element and an outer layer composed of an elastomeric material;

a pressure roller in contact with the fuser roller and having an outer layer composed of an elastomeric material;

a first hollow heating roller having an internal heating element, the first heating roller external to and being in contact with the fuser roller; and a second hollow heating roller having an internal heating element, the second hollow heating roller external to and being in contact with the pressure roller.

8. The system of claim 7, wherein the pressure roller comprises a hollow tube and an internal heating element.

9. The system of claim 7, wherein the internal heating elements comprise tungsten filament halogen lamps.

10. A device in which toner is fused to a recording medium, comprising:

means for attracting toner to a surface of the recording medium; and a fusing system including a hollow fuser roller having an internal heating element and an outer layer composed of an elastomeric material, a pressure roller in contact with the fuser roller and having an outer layer composed of an elastomeric material, a first hollow heating roller having an internal heating element, the first heating roller being in contact with the fuser roller, and a second hollow heating roller having an internal heating element, the seocnd heating roller being in contact with the pressure roller.

11. The device of claim 10, wherein the internal heating elements comprise tungsten filament halogen lamps.

* * * * *